US009303416B1

(12) United States Patent
Weldy et al.

(10) Patent No.: US 9,303,416 B1
(45) Date of Patent: Apr. 5, 2016

(54) SPRAY APPARATUS

(71) Applicant: Westpac Materials, Orange, CA (US)

(72) Inventors: Derrell Weldy, Orange, CA (US); Mark Hamilton, Orange, CA (US)

(73) Assignee: WESTPAC MATERIALS, Orange, CA (US)

( * ) Notice: Subject to any disclaimer, the term of this patent is extended or adjusted under 35 U.S.C. 154(b) by 0 days.

(21) Appl. No.: 14/852,381

(22) Filed: Sep. 11, 2015

Related U.S. Application Data

(60) Provisional application No. 62/081,995, filed on Nov. 19, 2014.

(51) Int. Cl.

| | |
|---|---|
| ***B05B 3/02*** | (2006.01) |
| ***E04F 21/12*** | (2006.01) |
| ***B05B 9/03*** | (2006.01) |
| ***E04F 21/04*** | (2006.01) |

(52) U.S. Cl.
CPC . *E04F 21/12* (2013.01); *B05B 9/03* (2013.01); *E04F 21/04* (2013.01)

(58) Field of Classification Search
CPC ..... B05B 3/00; B05B 3/02; B05B 9/00; B05B 9/03; E04F 21/04; E04F 21/06; E04F 21/08; E04F 21/10; E04F 21/12
USPC ..... 239/215, 219–222, 223, 224
See application file for complete search history.

(56) References Cited

U.S. PATENT DOCUMENTS

| | | | | |
|---|---|---|---|---|
| 1,686,968 | A * | 10/1928 | Harber | A21B 3/16 118/300 |
| 3,524,589 | A | 8/1970 | Pelton, Jr. | |
| 3,741,438 | A | 6/1973 | Gardioni | |
| 3,880,356 | A | 4/1975 | Chandler | |
| 4,040,154 | A | 8/1977 | Riley | |
| 4,288,036 | A | 9/1981 | Jubinville | |
| 4,453,650 | A | 6/1984 | Witte et al. | |
| D274,794 | S | 7/1984 | Witte | |
| 4,822,644 | A | 4/1989 | Krueger | |
| 5,127,579 | A | 7/1992 | Tempelman | |
| 5,181,349 | A | 1/1993 | Schaffer | |
| 5,715,975 | A | 2/1998 | Stern et al. | |
| 5,727,736 | A | 3/1998 | Tryon | |
| 5,881,955 | A | 3/1999 | Styne | |
| 6,056,213 | A | 5/2000 | Ruta et al. | |
| 6,116,473 | A | 9/2000 | Stern et al. | |
| 6,276,570 | B1 | 8/2001 | Stern et al. | |
| 6,726,125 | B1 | 4/2004 | Nonis et al. | |

(Continued)

FOREIGN PATENT DOCUMENTS

| | | |
|---|---|---|
| EP | 1867396 | 12/2007 |
| GB | 798406 | 7/1958 |

*Primary Examiner* — Christopher Kim
(74) *Attorney, Agent, or Firm* — Cislo & Thomas, LLP

(57) ABSTRACT

An improved spray apparatus designed to optimize the pattern of the texture material and the performance of the spray apparatus to look and perform similar to a hopper texture gun or texture spray rig used by professionals. The spray apparatus, has a housing defining a cavity. A transfer wheel is rotatably mounted to the housing, the transfer wheel having a hub defining a hub axis, and a plurality of transfer flaps. A propeller is rotatably mounted to the housing and positioned above the transfer wheel, the propeller having a spindle and a plurality of fins. A firing pin is attached to the housing above the propeller. An actuator is mounted to the housing to cause the propeller to rotate.

15 Claims, 15 Drawing Sheets

(56) References Cited

U.S. PATENT DOCUMENTS

| | | | |
|---|---|---|---|
| 7,350,723 | B2 | 4/2008 | Reedy |
| 7,481,338 | B1 | 1/2009 | Stern et al. |
| 7,617,995 | B2 | 11/2009 | Florio |
| 7,731,104 | B2 | 6/2010 | Peterson et al. |
| 7,861,950 | B2 | 1/2011 | Rossner et al. |
| 8,025,243 | B2 | 9/2011 | Charpie |
| 8,157,135 | B2 | 4/2012 | Stern et al. |
| 8,210,449 | B2 | 7/2012 | Peterson et al. |
| 2007/0119984 | A1 | 5/2007 | Woods |
| 2007/0125879 | A1 | 6/2007 | Khamenian |
| 2008/0230002 | A1 | 9/2008 | Hirata et al. |
| 2010/0111758 | A1 | 5/2010 | Brady |
| 2011/0297754 | A1 | 12/2011 | Valdez |
| 2012/0100296 | A1 | 4/2012 | Larson et al. |

* cited by examiner

SPRAY APPARATUS

CROSS REFERENCE TO RELATED APPLICATION

This patent application claims the benefit of U.S. Provisional Patent Application Ser. No. 62/081,995, filed Nov. 19, 2014, entitled "EZ Patch Spraying Apparatus," which application is incorporated in its entirety here by this reference.

TECHNICAL FIELD

This invention relates to aerosol textured spray guns providing professional grade quality.

BACKGROUND

There are many known methods for applying a texture finish to a drywall surface. For a large area, contractors typically use trailer-mounted spray machines to finish drywall surfaces. These machines have large capacity tanks where powdered material is mixed with water. The material is pumped through a hose to the spray gun. The finish can be varied from fine to heavy by changing tips in the spray gun nozzle, adjusting air pressure, or by changing the viscosity of the texture material. This application is typically done only by a professional at the time of building the structure.

Hopper guns are often used for mid-sized texture jobs and for touch-ups. A hopper is similar to a trailer-mounted machine but on a smaller scale. It uses a portable hopper and compressed air to spray texture on the drywall surface. Changing air pressure and nozzles are also used to achieve desired texture pattern, which requires the applicator to have skill similar to the trailer mounted machine applicator. The use of a compressor or the ability to clean the hopper is sometimes difficult or not possible as electricity and water may not be available. Also, storm water regulations may not permit cleaning the hopper on site. Current aerosol texture spray can technology provides a convenience to the applicator by not having to use a bulky or heavy compressor and clean the hopper texture spray gun after a patch is complete.

Aerosol texture spray cans are primarily designed to apply texture to finish drywall patches in an attempt to match existing wall texture patterns. Current texture spray can technology is accomplished by mixing a propellant and texture together in an aerosol can that is expelled through a dip-tube and then a spray tip. This eliminates the need in dealing with compressors, hoses, cleaning, and other cumbersome equipment for jobs where they are not warranted or feasible. While spray cans are convenient, they have some significant drawbacks.

Current texture spray can technology is accomplished by mixing a propellant and texture together in an aerosol can that is expelled through a dip-tube and then a spray tip.

The current propellant commonly used for this is an aerosol known as DME (Dimethyl ether). Because the propellant and texture are mixed together in the aerosol can, the propellant is part of the liquid that contributes to the flow and viscosity of the texture from the can. When the liquid propellant is expelled or released from the spray can, the gas is designed to expand thus giving the spray velocity or propellant for the material from the can's spray nozzle.

A major disadvantage of combining the texture material and the propellant together is that the propellant is still expanding and escaping from within the textured material once it is applied to the wall patch. This creates what is known in the drywall industry as pin-holing (as seen in FIG. 1).

Pin-holing is a negative attribute in professionally applied work and is often unacceptable and the applicator is required to repair the pin-holing to a professional standard. This issue is not able to be resolved by a practical amount of defoamer in the texture material formula.

In addition, because current aerosol spray can technology does not incorporate a "positive" shut-off mechanism at the tip of spray tips, the mixed propellant and texture material continues to build up and flow at the tip of the spray tip as the propellant gas continues to expand within the texture material (as seen in FIG. 2). This causes "spitting" of the texture material once the aerosol valve is activated again (as seen in FIG. 3). The "spitting" of material causes larger spots of texture pattern that are not uniform in pattern. "Spitting" of material is a negative attribute in professionally applied work and is often unacceptable. The professional applicator is often required to repair the non-uniform texture pattern to a professional standard.

Further, the aerosol texture spray can industry trend has been to offer an increasing amount of square footage coverage. This is where more texture material is offered in a single can. Current technology has practical and physical limitations as to the amount of square footage coverage they can offer. A typical aerosol texture spray can that contains increased square footage coverage comes with 25 ounces of texture material plus the appropriate amount of aerosol propellant. This larger texture volume can measure approximately 12 inches in height and weighs approximately 1.5 pounds. In order to further increase square foot coverage by an additional 50% the texture spray can would have to be 18 inches in height and weigh approximately 2.25 pounds. An 18-inch high texture spray can create logistical issues especially on store shelves and is a practical inconvenience for the applicator to use. This also causes increased shipping costs since many spray cans are delivered direct to stores.

In addition, the aerosol texture spray can industry typically utilizes DME (Dimethyl ether). One of the main advantages for its use is that DME is compatible with water-based materials. Because most of the texture materials on the market are water-based, DME mixes well with the texture material in the aerosol can and provides the necessary pressure to achieve the appropriate spray pattern. One of the major disadvantages of DME is that it is highly flammable. The auto ignition temperature of DME is approximately 662° F. Note; the temperature of an idly burning cigarette is over 1000° F. Certain compatible aerosols that mix with the water-based texture materials also contain volatile organic compounds (VOCs) that are not environmentally friendly or healthy for the applicator. Because typical spray can technology mixes the propellant with the texture material in the can to achieve an appropriate spray texture pattern, the choices of propellants are limited as well.

Since the appropriate mixture of DME or suitable propellant must be mixed with the texture material to achieve the required spray pattern, a further disadvantage of current spray can technology is that the mixture of texture material to propellant cannot be adjusted by the applicator. It is a fixed ratio in the aerosol can.

Professional texture hopper guns allow for the amount of texture material to be varied in relation to their air source. This is important when matching the existing texture of a wall while doing repair work. To better match existing textures, professionals often "feather" the texture around the patched area. Feathering is accomplished by keeping the air pressure constant while limiting the amount of texture material that is sprayed from the texture hopper gun so that the edges of the patch have lighter and lighter amounts of texture material towards the outer edges of the patch. This visually blends the new texture subtly with the original texture that was applied at the time of construction so that the patch is less noticeable.

Furthermore, it is common in the texture spray can industry to have a high number of product returns. This is not only inconvenient for the consumer or applicator, but it is costly and time consuming for the stores that sell the aerosol texture spray cans. The high number of returns is due to the nature of the product. Texture material is typically much thicker than paint due to the high solids needed to create the texture pattern. The heavy texture is typically pushed by the propellant through a dip-tube or "feed-tube" that extends down into the can. The heavy bodied texture must then pass through a relatively small valve to the spray tip. This often leads to product malfunctions and clogging. Many times a dried piece of the texture material can clog the spray can valve. Slight activation of the material valve can occur as well during the assembly of the spray can which can cause a small amount of material to become hardened in the valve components. In addition, because the aerosol and material are mixed together, there is a disadvantage in the current technology since there is a limitation on how big the valve openings can be to achieve a desired texture pattern due to the level of propellant needed to create the force to spray.

Thus, there remains a need for a spray apparatus that applies a texture material to a wall, which better represents, and that can better match, the professional textures originally applied to the walls or surfaces when the structure was originally built and that can functionally and practically facilitate additional square foot coverage of the texture material. Consumers and retailers would also benefit from a more reliable product with fewer returns to the store. In addition, there remains a need for an environmentally friendly and a safer, non-flammable texture delivery system that is also more economical and safer to ship and handle.

SUMMARY

Accordingly, a primary object of the present invention is to provide a spray apparatus with optimized professional material performance and texture pattern without the negative drawbacks. The spray apparatus comprises a housing contain the transfer wheel, a propeller, a firing pin, and an actuator. The actuator rotates the propeller. The propeller injury rotates the transfer wheel which scoops up the material to be sprayed. The spray material is transferred onto the propeller. The propeller about against the firing pin which creates potential energy in the propeller. When the propeller is able to slide underneath the firing pin, the propeller flings the spray material onto the wall.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
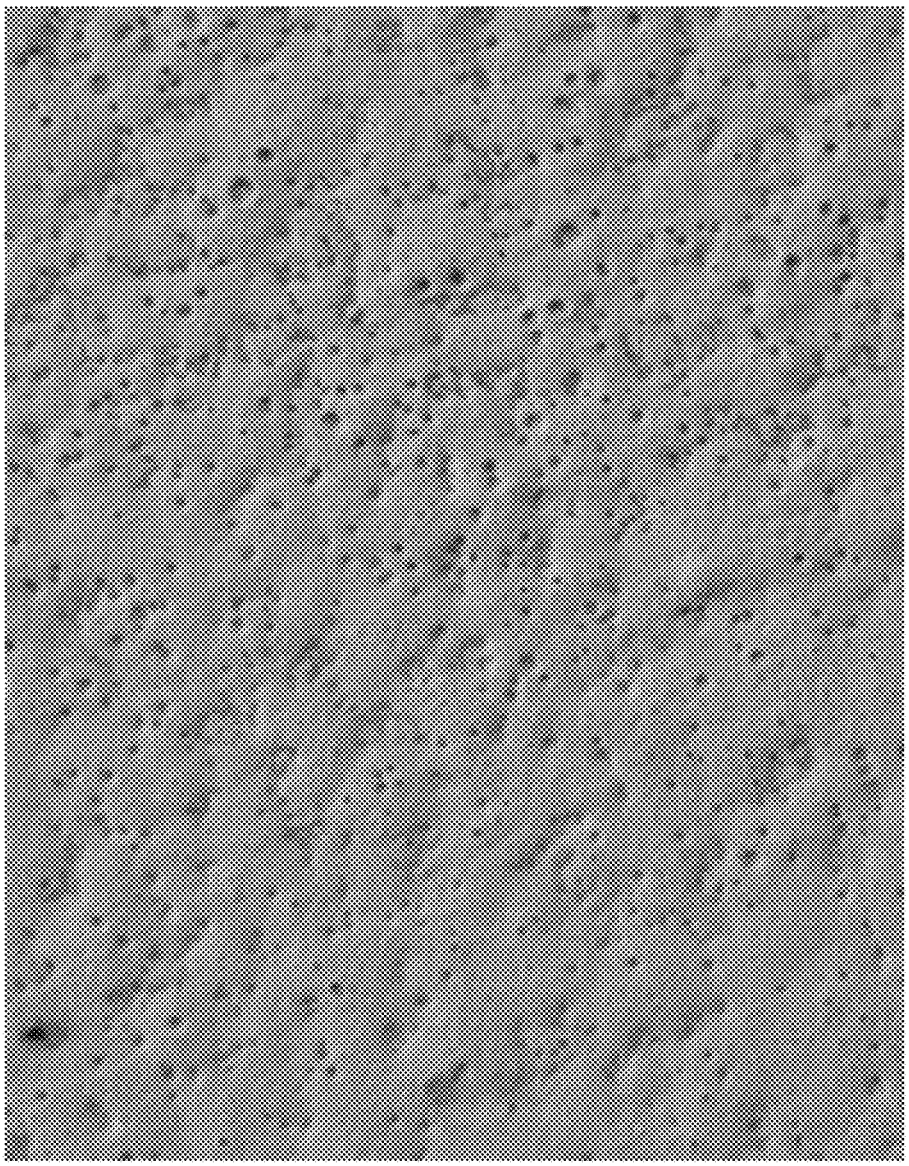
Fig. 1 (Prior Art)
FIG. 1 shows a prior art spray texture with undesirable pin holes.
Figure 2:
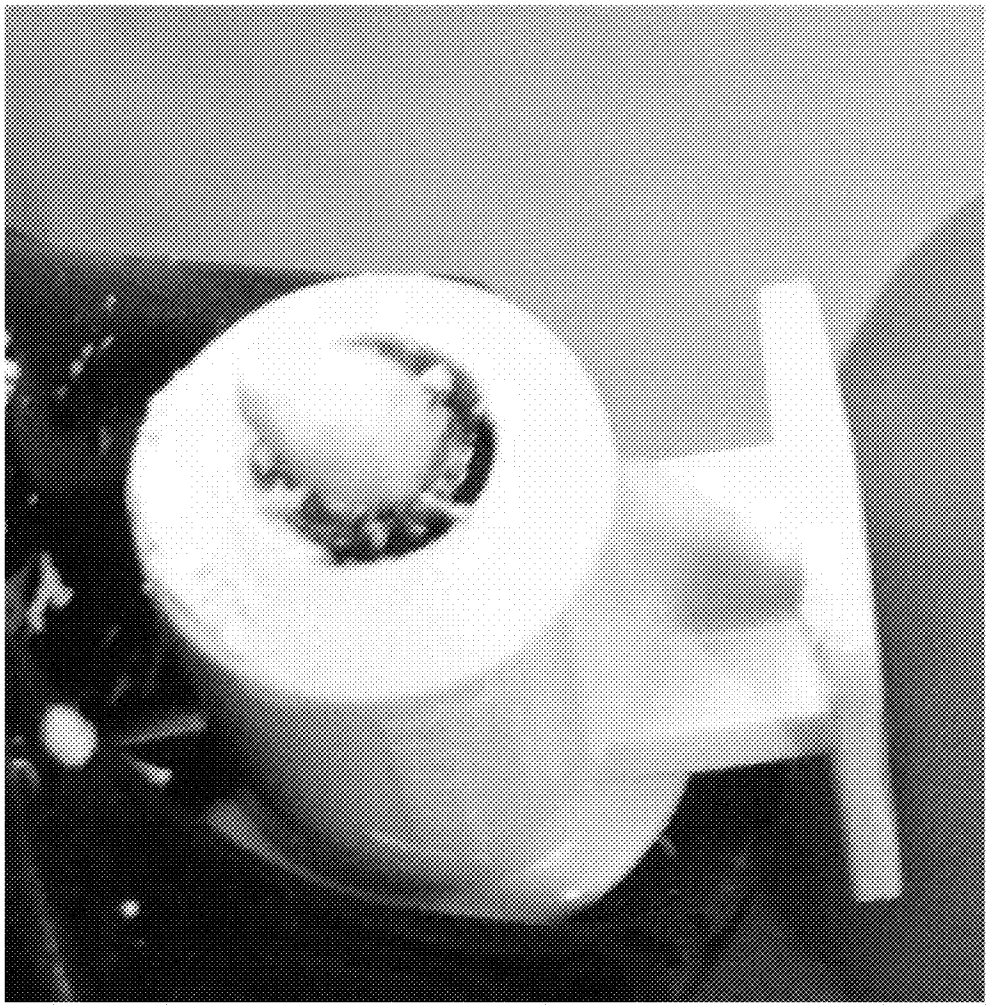
Fig. 2 (Prior Art)
FIG. 2 shows a prior art spray nozzle with leaking spray material.
Figure 3:
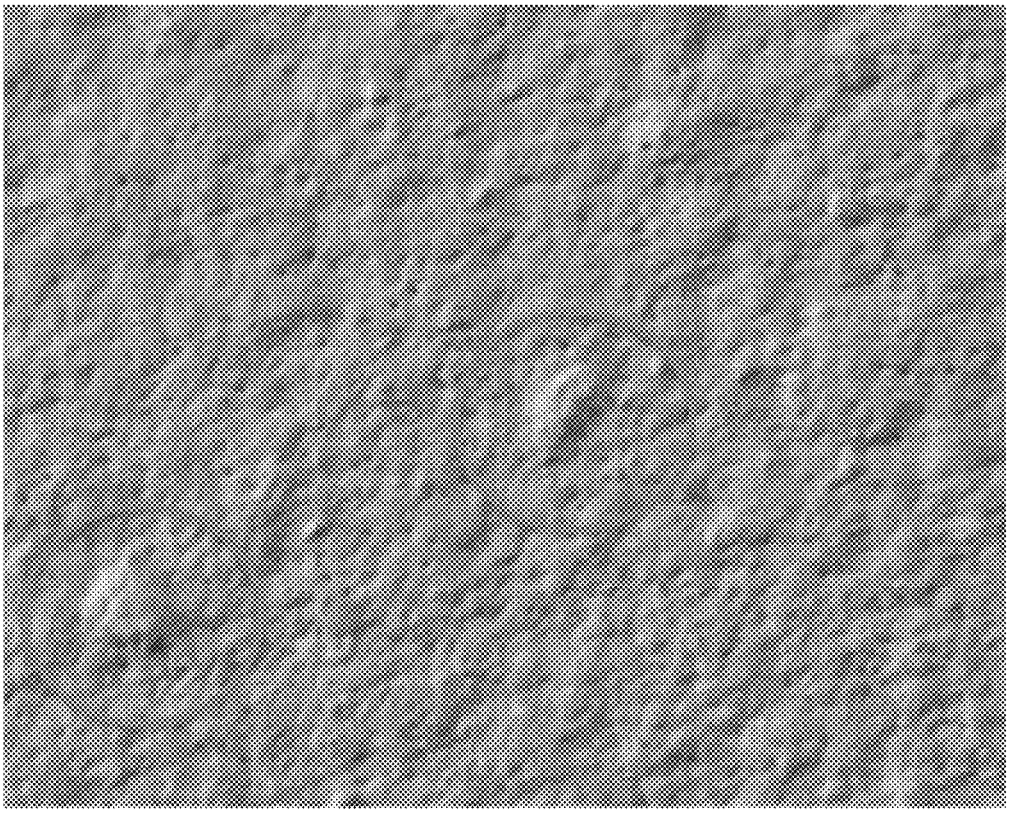
Fig. 3 (Prior Art)
FIG. 3 shows a prior art spray texture with a spitting.
Figure 4:
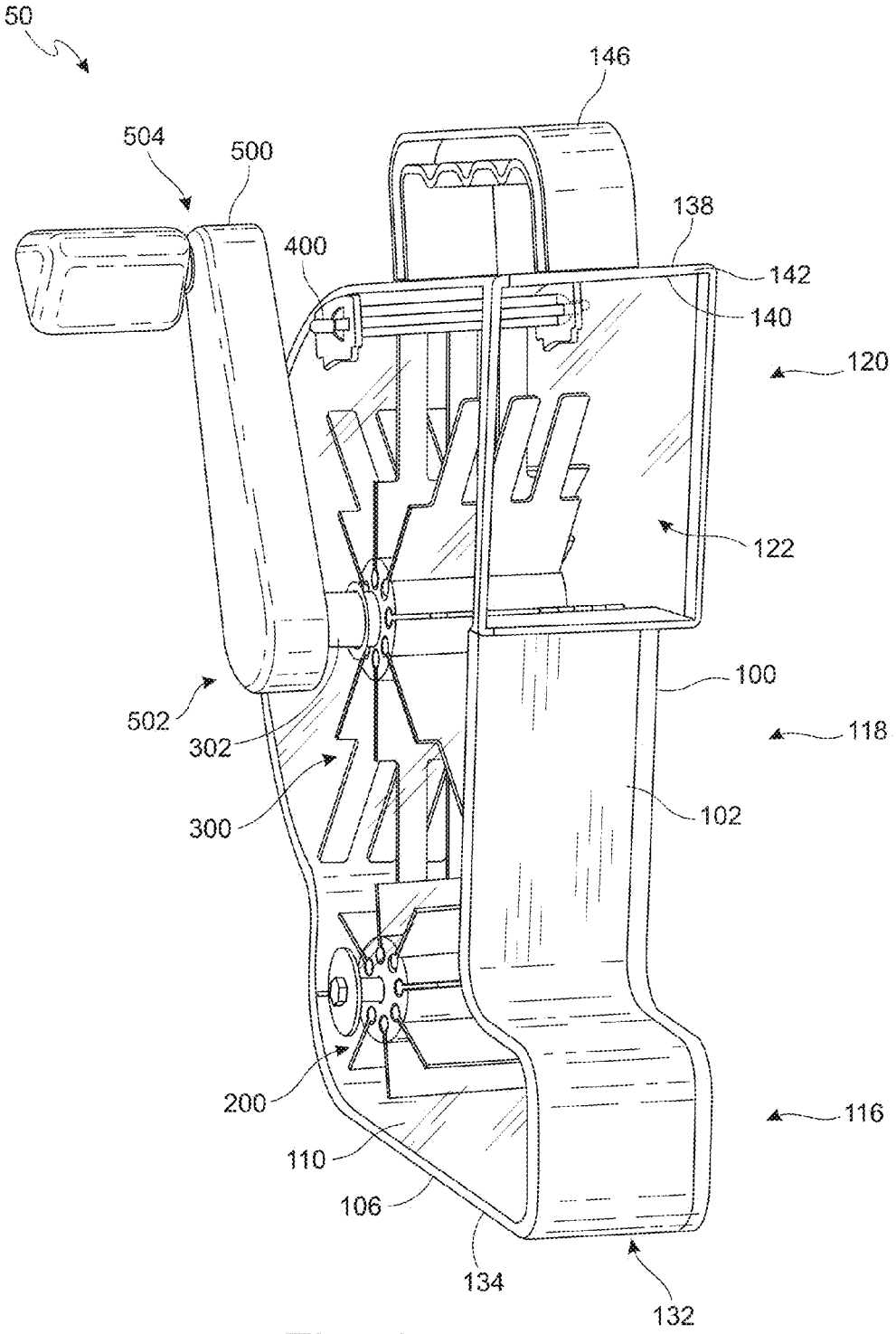
FIG. 4 is a front perspective view of an embodiment of the present invention.
Figure 5:
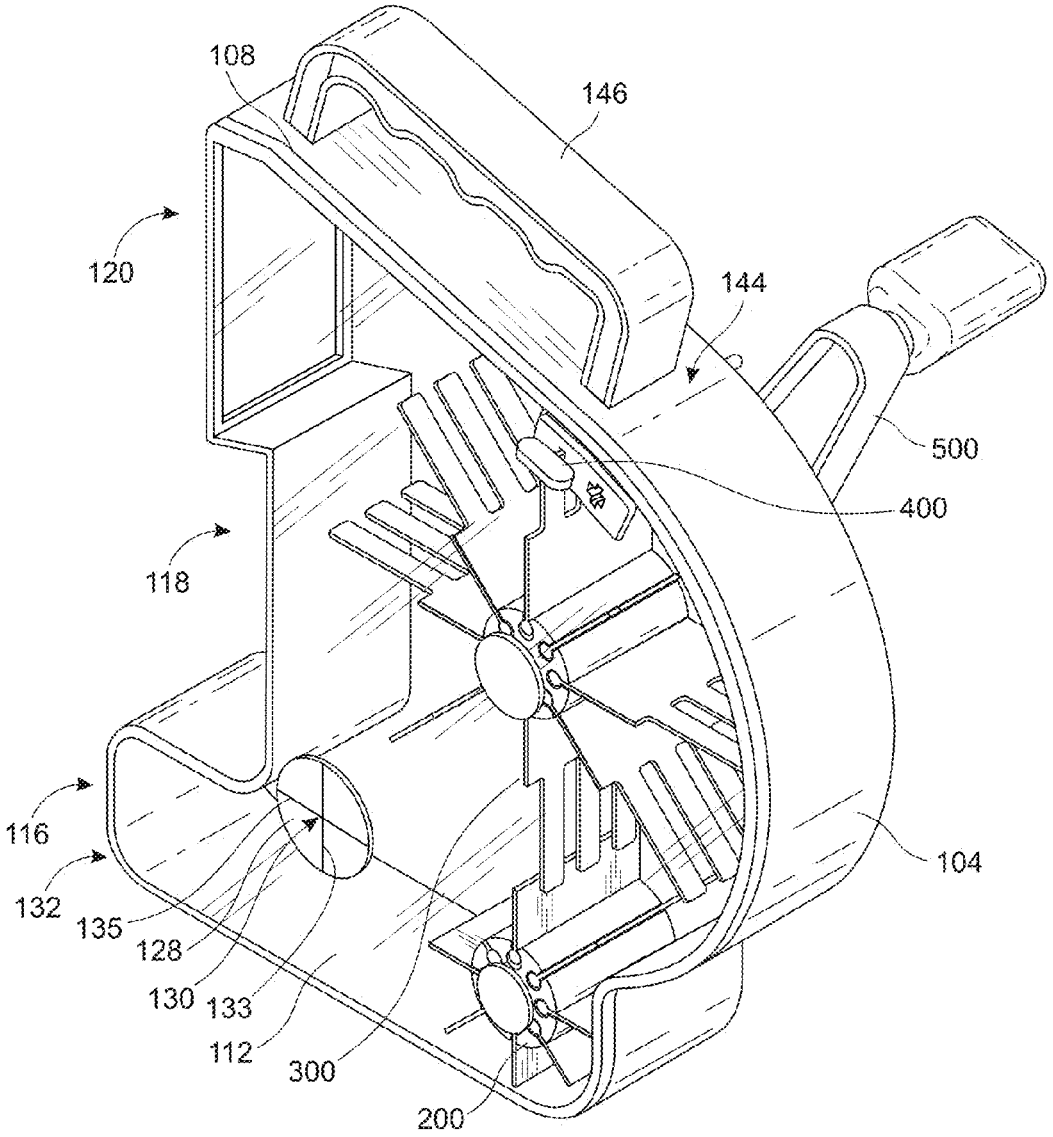
FIG. 5 is a rear perspective view of the embodiment of FIG. 4.
Figure 6:
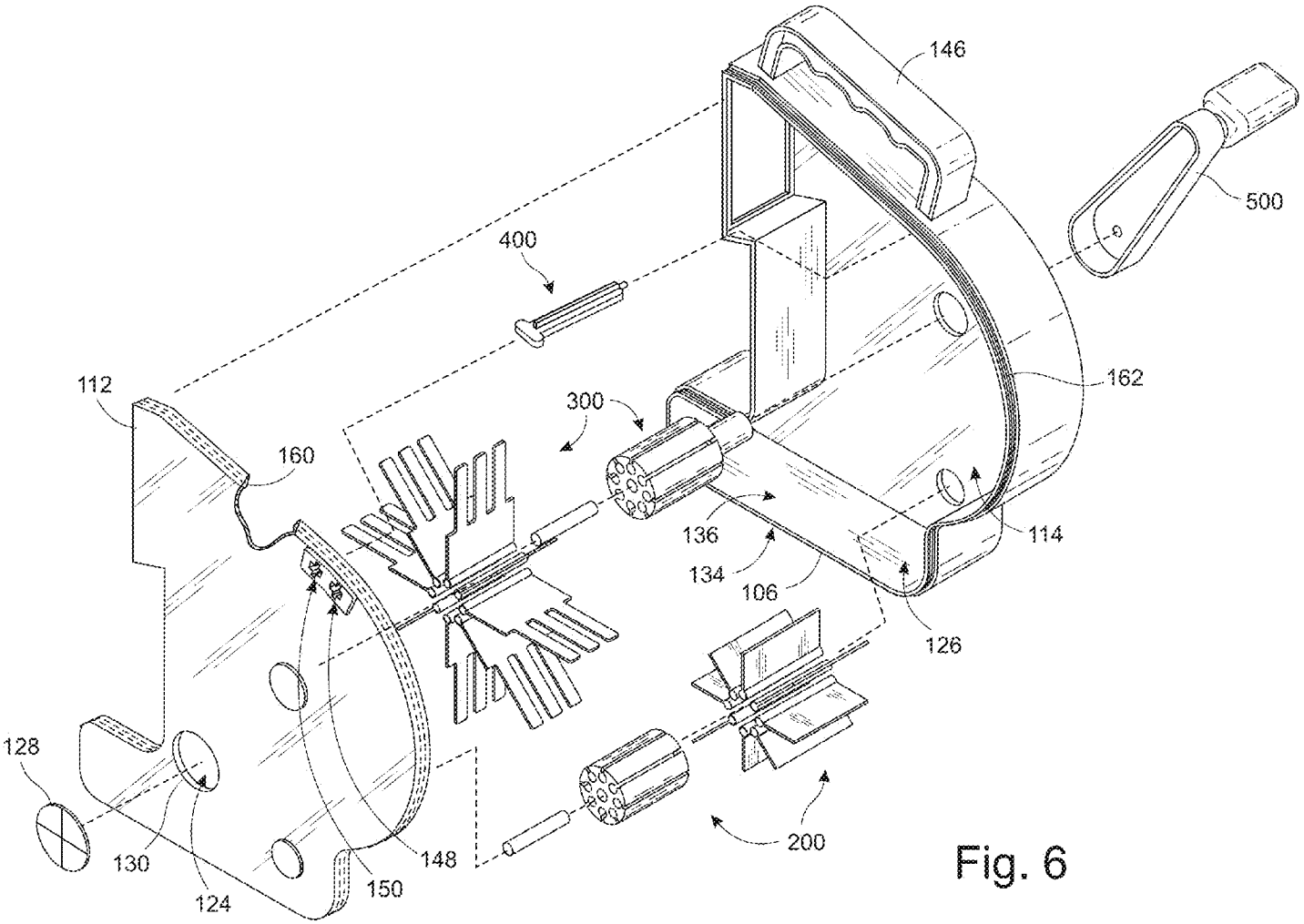
FIG. 6 an exploded view of the embodiment shown in FIG. 4.

As shown in FIGS. 4-6, the spray apparatus 50 of the present invention comprises a housing 100, a transfer wheel 200 rotatably mounted to the housing 100 to take up material 10 (such as viscous spray material to be applied to walls) in the housing 100, a propeller 300 rotatably mounted to the housing 100 to receive the material taken up by the transfer wheel 200, a firing pin 400 attached to the housing 100 to create resistance for the propeller 300, and an actuator 500 mounted to the housing 100 to rotate the propeller 300. In general, the transfer wheel 200, the propeller 300, the firing pin 400, and the actuator 500 are arranged relative to each other such that actuation of the actuator 500 causes rotation of the propeller 300, rotation of the propeller 300 causes the transfer wheel 200 to scoop up the material 10 in the housing 100 and transfer it to the propeller 300. Continuous rotation of the propeller 300 causes the propeller 300 to temporarily abut against the firing pin 400 causing the fin 304 of the propeller 300 to bend backwards until the fin 304 is able to slide underneath the firing pin 400, which in turn leads to the fin 304 to springing abruptly forward, thereby flinging the material 10 in the forward direction.

The Housing

In the preferred embodiment, the housing 100 is defined by a front wall 102, a back wall 104 opposite the front wall 102, a bottom wall 106 adjacent to the front wall 102 and the back wall 104, a top wall 108 opposite the bottom wall 106, and adjacent to the front wall 102 and the back wall 104, a first side wall 110 adjacent to the front wall 102, the back wall 104, the bottom wall 106, and the top wall 108, and a second side wall 112 opposite the first side wall 110 and adjacent to the front wall 102, the back wall 104, the bottom wall 106, and the top wall 108, wherein the front wall 102, the back wall 104, the bottom wall 106, the top wall 108, and the two side walls 110, 112 define a cavity 114 of the housing 100. The housing 100 comprises a lower section 116 bound by the bottom wall 106, an upper section 120 bound by the top wall 108, and a middle section 118 therebetween.

The front wall 102 at the upper section defines an opening 122 into the cavity 114. Viscous material 10 flung from the propeller 300 exits the housing 100 through this opening 122.

The housing 100 further comprises a fill hole 124 through which the material 10 can be introduced into the housing 100. Preferably, the hole 124 is strategically positioned so as not to interfere with the propeller 300 when the viscous material 10 is introduced into the housing 100. For example, the hole 124 may be positioned on the housing 100 below the opening 122. In the preferred embodiment, the hole 124 may be positioned below the propeller 300. The hole 124 may be positioned in the lower section 116 on one of the side walls 110, 112. In the lower section 116, the walls 110, 112, 106 of the housing 100 define a trough 126 to hold the material 10.

Figure 10:
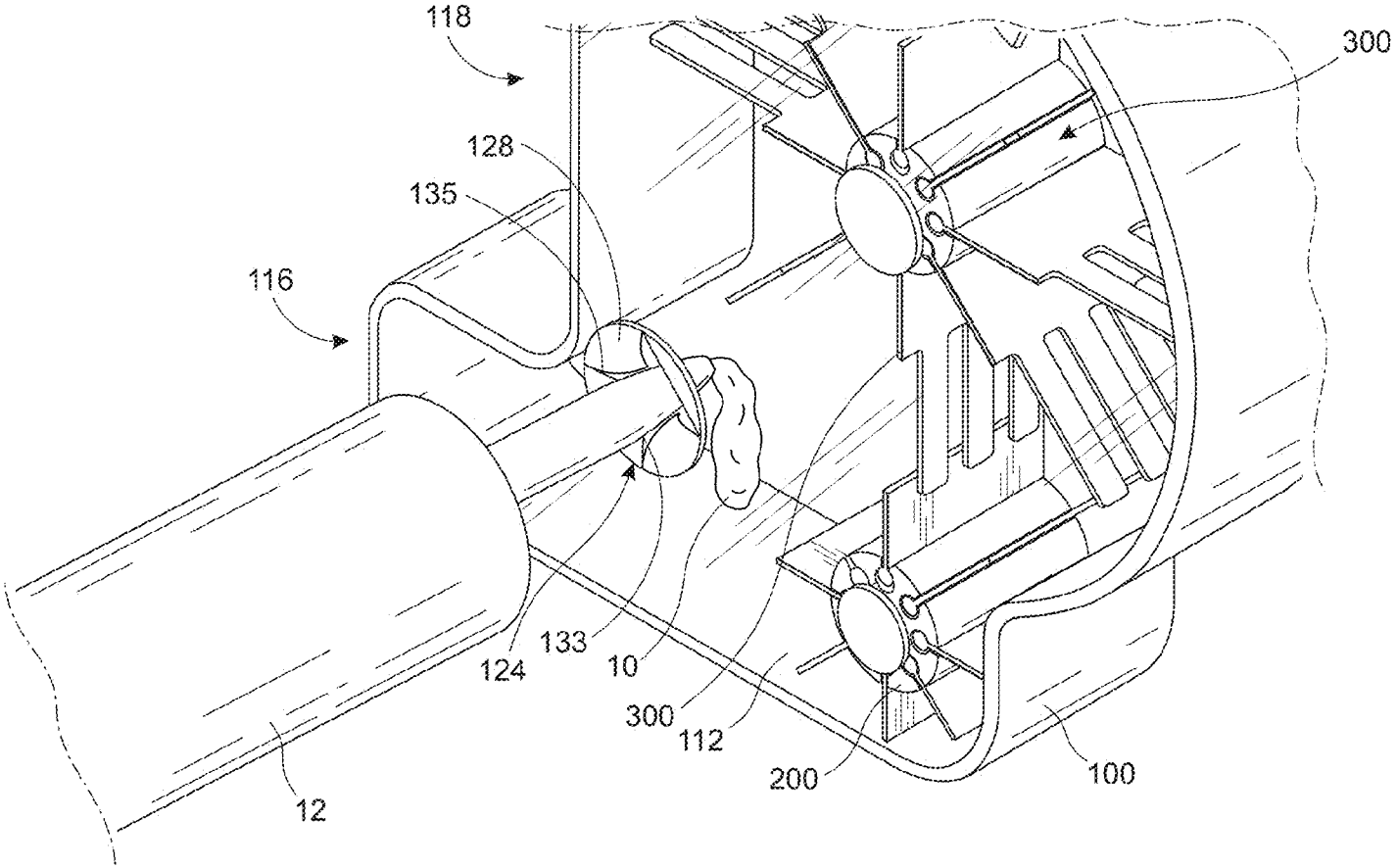
FIG. 10 shows the spray material being deposited into the spray apparatus.

The hole 124 may be closed with a cover 128 that can be opened and closed, such as a door, a hatch, a window, a re-sealing flap, and the like. In the preferred embodiment, the cover 128 is a re-sealing flap defining a central orifice 130. During a state of rest, the central orifice 130 is small enough that the viscous material 10 would not pass in or out of the orifice 130. When a poignant pressure is applied to the central area of the cover 128, the orifice 130 is allowed to grow. This would allow a tip of some delivery device 12 to be inserted through the orifice 130 to deposit the material 10 inside the housing 100, as shown in FIG. 10. After the material 10 is deposited into the housing 100 and the delivery device is removed from the orifice 130, the orifice 130 returns back to its resting state. Even if the material 10 loaded into the housing raises above the orifice 130, the material 10 would still not be able to leak out of the orifice 130 due to the viscosity of material 10 and the size of the orifice 130 in its natural state.

By way of example only, the cover 128 may be a plastic sheet of flexible material affixed over the fill hole 124. Vertical and horizontal slits 133, 135 may be created in the cover 128 from one end of the holes 124 to the opposite end and through the center. The vertical and horizontal slits 133, 135 divide the cover 128 into four distinct pieces each having a terminal point meeting at the center of the cover. Since the terminal points are unconnected at the center, the small orifice 130 is created there. When a delivery device is pressed against the cover 128, the four distinct pieces are pushed inwardly thereby increasing the size of the orifice 130. This allows the tip of the delivery device to enter into the housing 100. Once the material 10 from the delivery device is delivered into the housing 100, the delivery device is pulled away from the cover 128. This allows the four distinct pieces to return back to their original positions thereby decreasing the size of the orifice 130. In some embodiments in which the amount of the material raises higher than the level of the hole 124, the material 10 itself will apply pressure against the four distinct pieces facilitating closure of these four distinct pieces back to their original configuration.

Once the material 10 is delivered inside the housing 100, the material 10 resides in the lower section 116 of the housing 100. In the preferred embodiment, the transfer wheel 200 is located closer to the back wall 104 of the housing 100. Therefore, in some embodiments, the front end 132 of the bottom wall 106 of the housing 100 may be raised to cause any material 10 to flow towards the back wall 104. This maximizes the material 10 available to be scooped up by the transfer wheel 200.

In general, the bottom wall 106 has a flat exterior side 134 and a flat interior side 136 that defines the floor of the housing 100. The flat exterior side 134 allows the housing 100 to stand on its own. In some embodiments, the bottom wall 106 may be adjustable from a flat, horizontal configuration to an angled configuration. In some embodiments, only the floor 136 may be adjustable. In other embodiments, the entire bottom wall 106 may be adjustable. Thus, when there are plentiful amounts of material inside the trough 126, the floor 136 may be in its flat, horizontal configuration to maximize space. As material 10 is used up, the floor 136 may be raised to allow material 10 to concentrate near the transfer wheel 200.

The top wall 108 has an exterior side 138 and an interior side 140 defining a ceiling. In some embodiments, the ceiling 140 of the housing 100 may be angled relative to bottom wall 106 in its flat, horizontal configuration. In particular, the ceiling 140 and the bottom wall 106 (when flat against the ground) may create an angle A ranging from approximately 10 degrees to approximately 30 degrees with the front end 142 of the ceiling 140 being higher than the back end 144 of the ceiling 140. Preferably, the angle A may range from approximately 15 degrees to approximately 20 degrees. Having an angled ceiling may reduce the chances of any material 10 that had splashed onto the ceiling 140 from dripping back onto the propeller 300 or in front of the propeller 300 where the drip could interfere with the material being flung. By having the ceiling 140 angled, any material that inadvertently splashes onto the ceiling 140 may migrate along the ceiling 140 towards the lower back end 144 and eventually down the back wall 104 back into the trough 126.

On the exterior side 138 of the top wall 108, a handle 146 may be attached or integrally formed. The handle 146 allows the housing 100 to be held in a convenient manner while actuating the actuator 500. The handle 146 can also be placed on any other wall 102, 104, 106, 110, 112.

For economy of space, the back wall 104 may be curved to accommodate the rotation of the propeller 300. As such, the curvature of the back wall 104 may be analogous or parallel to the rotational path of the propeller.

The housing 100 is generally made of plastic material, but any other rigid material, such as wood or metal can also be used using methods known in the art. Preferably, at least one of the side walls 110, 112 of the housing 100 is transparent so as to be able to see inside. In the preferred embodiment, at least one of the side walls 110, 112 of the housing 100 is removable from the rest of the housing 100. Preferably, the removable side wall can be snap fit onto the remainder of the housing 100 for quick and easy assembly, as well as quick and easy disassembly so as to be able to access the inner components of the invention. Therefore, one of the side walls 110, 112 may have a clip 160 to hook on to a groove 162 of the main body.

The Transfer Wheel

Figure 7A:
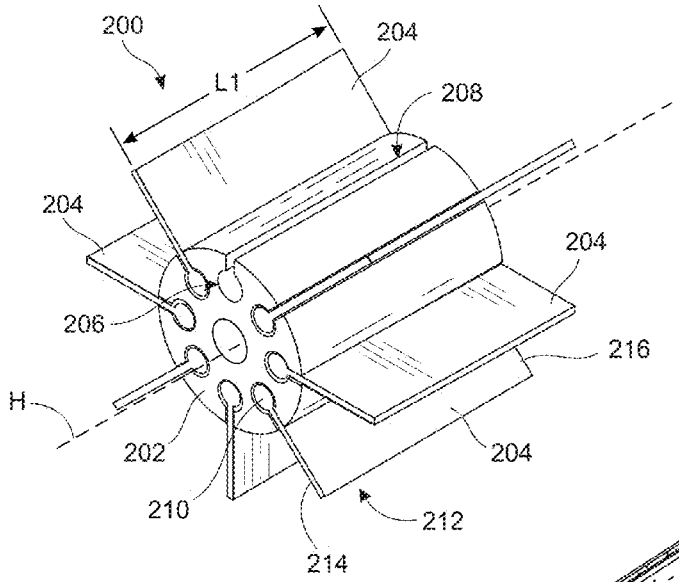
FIGS. 7A-7C are close ups of various embodiments of the transfer wheel.
Figure 7B:
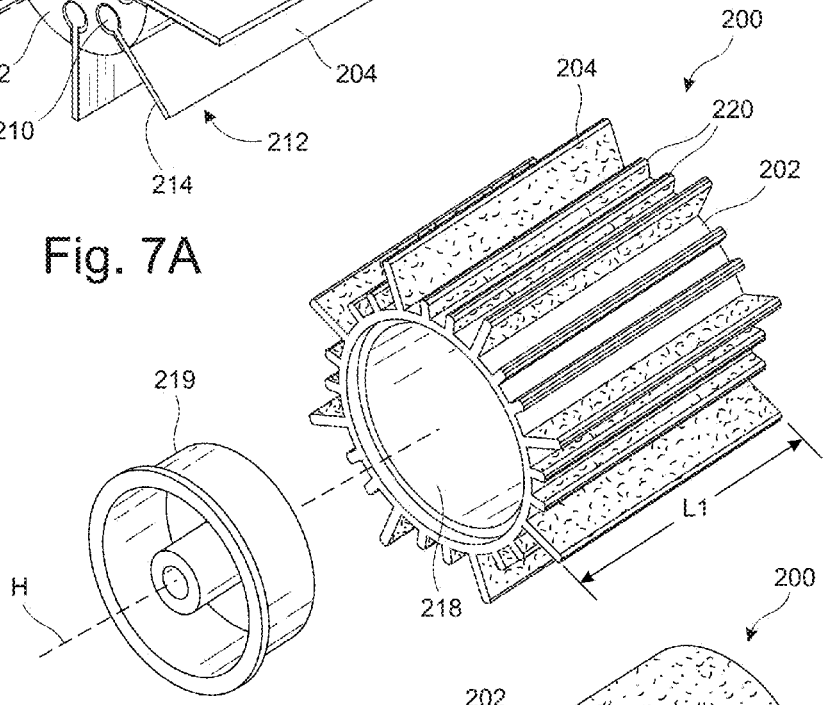
Figure 7C:
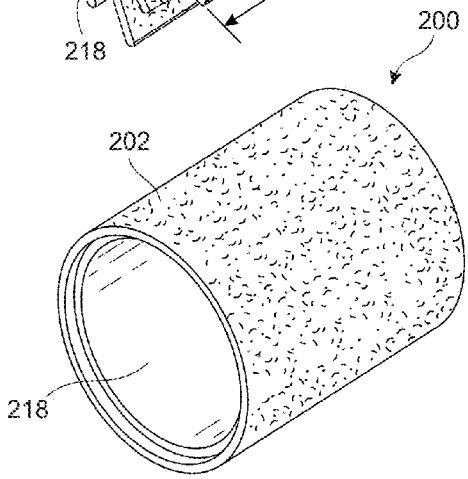

Located on the inside of the housing 100 at the lower section 116 is the transfer wheel 200 that can take up viscous material 10 residing in the lower section 116 of the housing 100 for transference to the propeller 300. In the preferred embodiment, the transfer wheel 200 is located adjacent to the back wall 104. As shown in FIGS. 7A-7C, the transfer wheel 200 comprises a hub 202 defining a hub axis H, and a plurality of transfer flaps 204. The hub axis H may be perpendicular to the first and second side walls 110, 112. The transfer flaps 204 project substantially radially outwardly from the hub 202 and are intermittently and angularly spaced apart about the hub axis H like spokes on a wheel.

In the preferred embodiment, the hub 202 is generally cylindrical in shape having a curved outer surface and a length L1. The transfer wheel 200 is attached to the housing 100 in such a manner that allows the transfer wheel 200 to rotate about the hub axis H. Therefore, when viewed from the side, the hub 202 can rotate clockwise or counterclockwise.

In some embodiments, as shown in FIG. 7A, angularly intermittently spaced apart about the outer surface of the hub 202 are a plurality of grooves 206 extending the length of the hub 202. In the preferred embodiment, each groove 206 has a cylindrical shape with an open slit 208 created in the outer surface. Each transfer flap 204 may have a generally rectangular shape defined by a first end 210, a second end 212 opposite the first end 210, and two side ends 214, 216 opposite each other and adjacent to the first and second ends 210, 212. The first end 210 of the transfer flap 204 may be attachable to the hub 202. Preferably, the first end 210 is formed into a cylindrical shaped rod. This rod can be slid into the groove 206 with the remainder of the transfer flap projecting out from the open slit 208. This allows each transfer flap 204 to be independently replaceable. Other fastening mechanisms can be used that allow the transfer flaps 204 to slide in, snap in, clip in, or otherwise fasten to the hub 202.

In some embodiments, as shown in FIG. 7B, the transfer flaps 204 may be integrally formed with the hub 202. In some embodiments, the transfer flaps 204 may be integrally formed with or attached to a cylindrical sleeve 218. The sleeve 218 may be mounted on to an end cap 219 that can be mounted on the housing 100. The sleeve 218 can rotate about the end cap 219 or rotate with the end cap 219. Although the end cap 219 is shown having a well, the end cap 219 may be flat. The end cap 219 can prevent the viscous material 10 from entering into the hub 202 or the cylindrical sleeve 218.

To facilitate pickup of the viscous material 10, the transfer flaps 204 may have a textured surface. In some embodiments, in between each transfer flap 204 may be one or more nubs 220. Each nub 220 may extend radially from the hub 202 and extend substantially the length of the hub 202. In the preferred embodiment, the projection of the nubs 220 past the hub 202 may be shorter than that of the transfer flaps 204. In addition, the nubs 220 may also be textured. Adding texture to the surface of the transfer flaps 204 and/or providing the nubs 220 (with or without textured surfaces) prevents the viscous material 10 from sliding off the transfer wheel 200. As the transfer wheel 200 rotates, the transfer flaps 204 collect the viscous material 10 in the lower section 116 of the housing 100 and pass portions of the viscous material 10 to the propeller 300.

In some embodiments, as shown in FIG. 7C, the transfer wheel 200 may not have any transfer flaps 204 or nubs 220. Rather, the hub 202 itself may be textured. The texturing on the hub 202 may provide sufficient friction to pick up viscous material 10 and transfer the viscous material 10 to the propellers 300. Texturing of the hub 202, the transfer flaps 204, or the nubs 220 can be achieved by creating any kind of non-smooth surface. For example, the surfaces may contain a plurality of bumps, divots, protrusions, waves, and the like, that may increase the friction of a surface.

The Propeller

Figure 8:
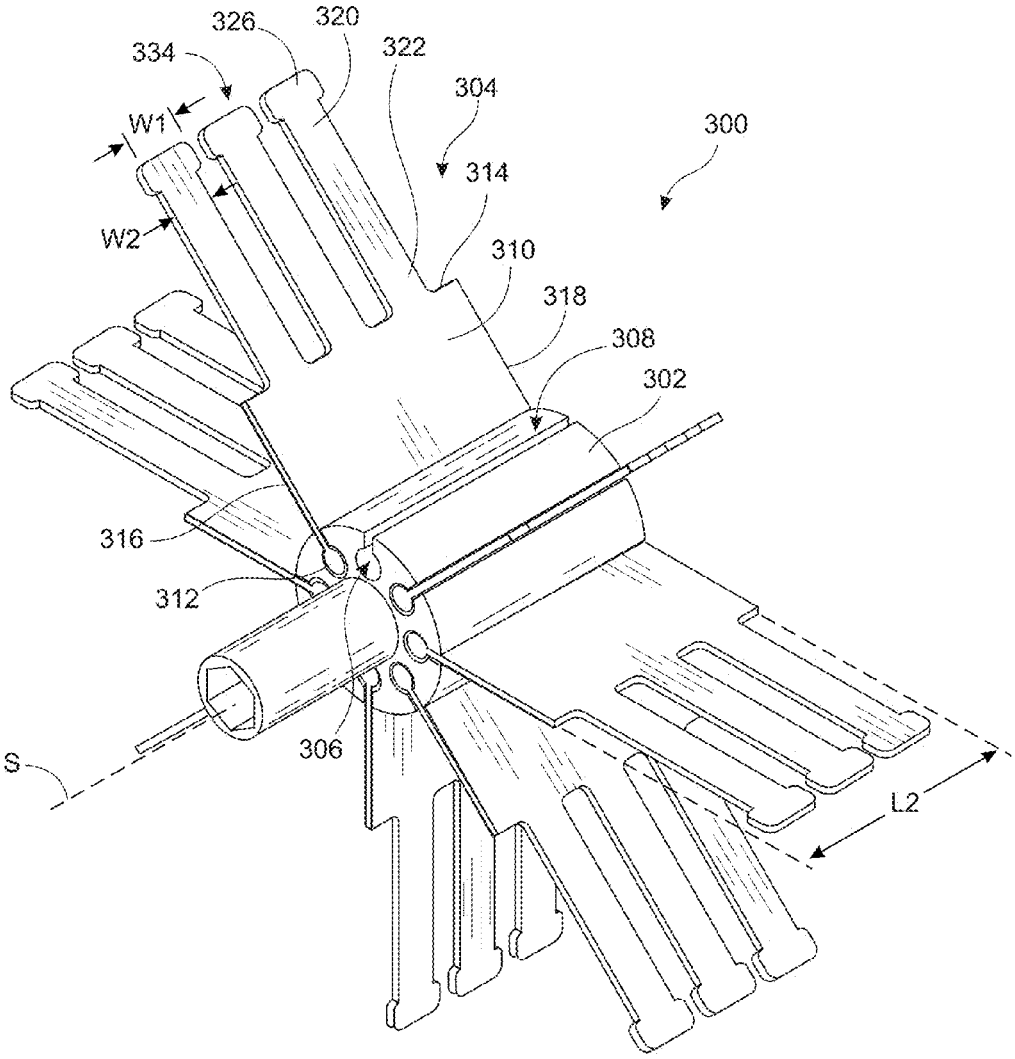
FIG. 8 is a close-up view of an embodiment of the propeller.

The propeller 300 is rotatably mounted to the housing 100 and positioned above the transfer wheel 200. As shown in FIG. 8, the propeller 300 comprises a spindle 302 and a plurality of fins 304. The spindle 302 defines a spindle axis S. The spindle axis S may be parallel to the hub axis H. The fins 304 project radially outwardly from the spindle 302 and are intermittently and angularly spaced apart about the spindle axis S. In the preferred embodiment, the spindle 302 is generally cylindrical in shape having a curved outer surface and a fixed length L2. The spindle 302 is attached to the housing 100 in such a manner that allows the spindle 302 to rotate about the spindle axis S. Therefore, when viewed from the side, the spindle 302 can rotate clockwise or counterclockwise. In some embodiments, angularly intermittently spaced apart about the outer surface of the spindle 302 is a plurality of grooves 306 extending the length of the spindle 302. In the preferred embodiment, each groove 306 has a cylindrical shape with an open slit 308 formed into the outer surface.

Each fin 304 may have a generally rectangular shaped base 310 defined by a first end 312, a second end 314 opposite the first and 312, and two side ends 316, 318 opposite each other and adjacent to the first and second ends 312, 314. The first end 312 of the base may be attachable to the spindle 302. Preferably, the first end 312 is formed into a cylindrical shaped rod. This rod can be slid into the groove 306 with the remainder of the base 310 projecting out from the open slit 308. This allows each fin 304 to be independently replaceable. In some embodiments, the fins 304 may be integrally formed with the spindle 302 as discussed for the transfer wheel.

Projecting from the second end 314 of the base 310 of each fin 304 is a set of arms 320. Each arm 320 within a set is spaced apart from each other along the length of the base 310. Preferably, each set of arms may contain 1 to 5 arms 320. More preferably, each set of arms may contain 2 to 4 arms 320. In the most preferred embodiment, each set of arms contains three arms 320. Each arm 320 is generally a flat, elongated rectangle having a proximal end 322 connected to the second end 314 of the base 310 and a free, distal end 324 opposite the proximal end 322.

The arms 320 are generally flexible and elastic. Therefore, the arms 320 can be bent and will return back to its natural position. This flexibility and elasticity allows the fin 304 to perform its function of flinging material 10 out of the housing 100. In some embodiments, the distal end 324 comprises a paddle 326. The paddle 326 provides a flat surface area on to which the material 10 can be transferred to from the transfer wheel 200. Preferably, the paddle 326 is generally rectangular in shape. However, any other shape can be used, such as circular, oval, star-shaped, triangular, pentagonal, hexagonal, and the like. The paddle 326 has a width W1 that is larger than the width W2 of its respective flexible arm 320.

Selecting the proper paddle 326 size with a particular shape and/or surface area based on the material 10 composition and/or viscosity may determine the texture characteristics of the material 10 upon application. For example, high viscosity material 10 may only need a paddle 326 with a small surface area, whereas low viscosity material 10 may require a paddle 326 with a larger surface area. To make it easier for the user, the fins 304 may be color coded to help the user identify the proper fin 304 necessary to get the desired results based on the composition and/or viscosity of the material 10. Color coded labels may be provided on the housing 100 or in a user's manual that instructs the user on how to select the proper fin 304. In some embodiments, color coding can take into account the flexibility of the arms 320 since the flexibility or stiffness of the arm 320 also plays a role in the ability to fling the material 10 out of the housing 100.

The Firing Pin

Figure 9A:
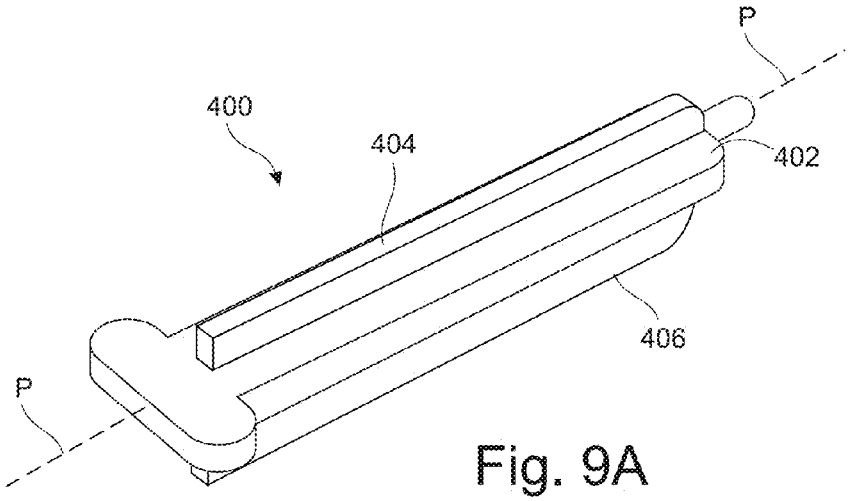
FIG. 9A-9C are close up views of embodiments of the firing pin.
Figure 9B:
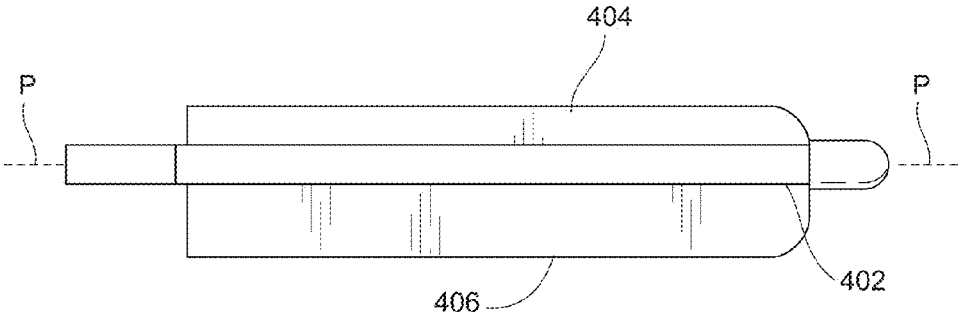
Figure 9C:
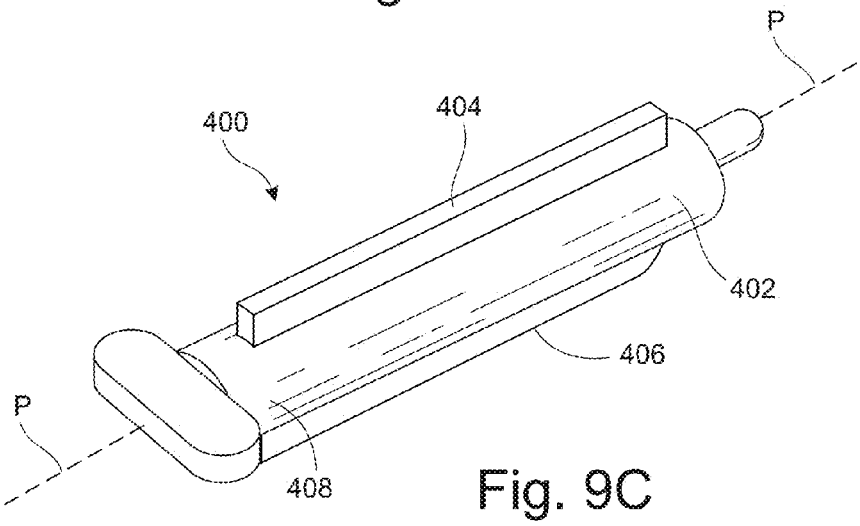
Figure 11A:
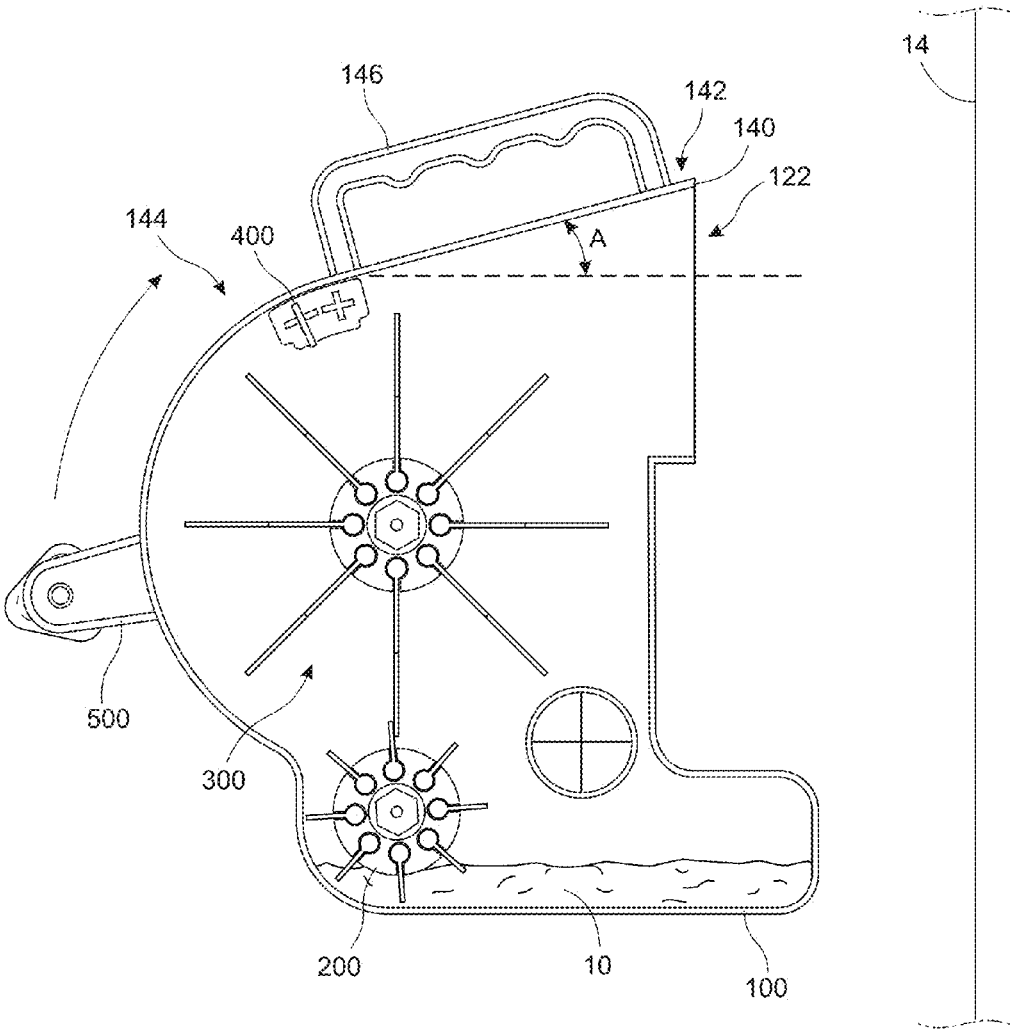
FIGS. 11A-11D shows the spray apparatus in use.
Figure 11B:
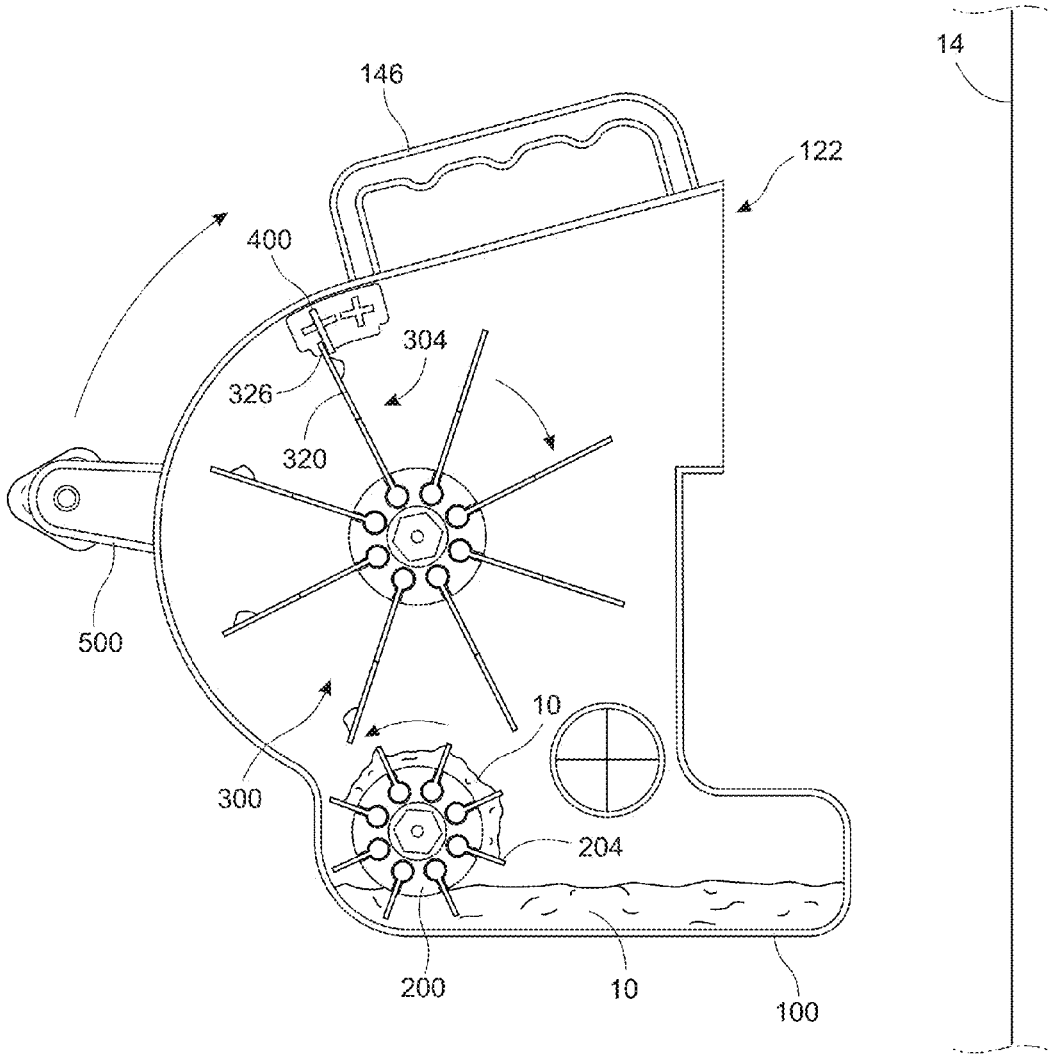
Figure 11C:
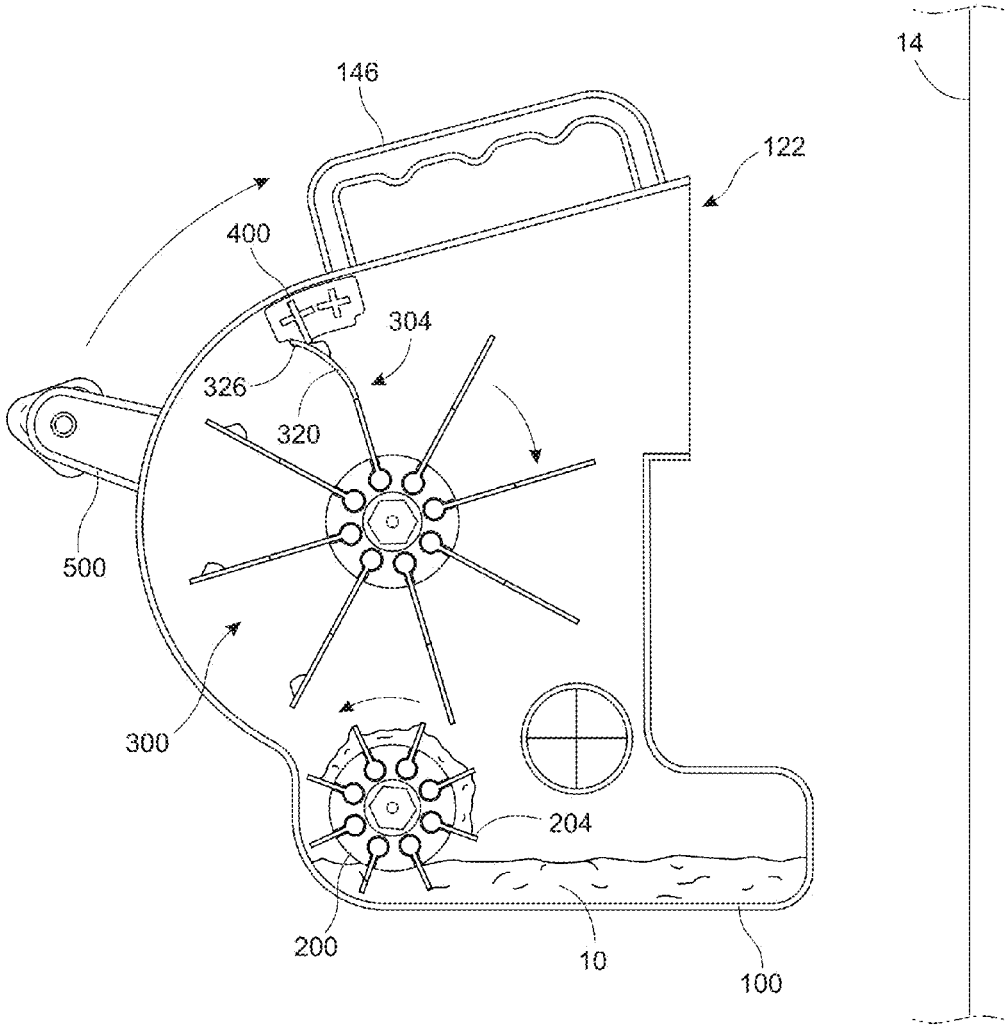
Figure 11D:
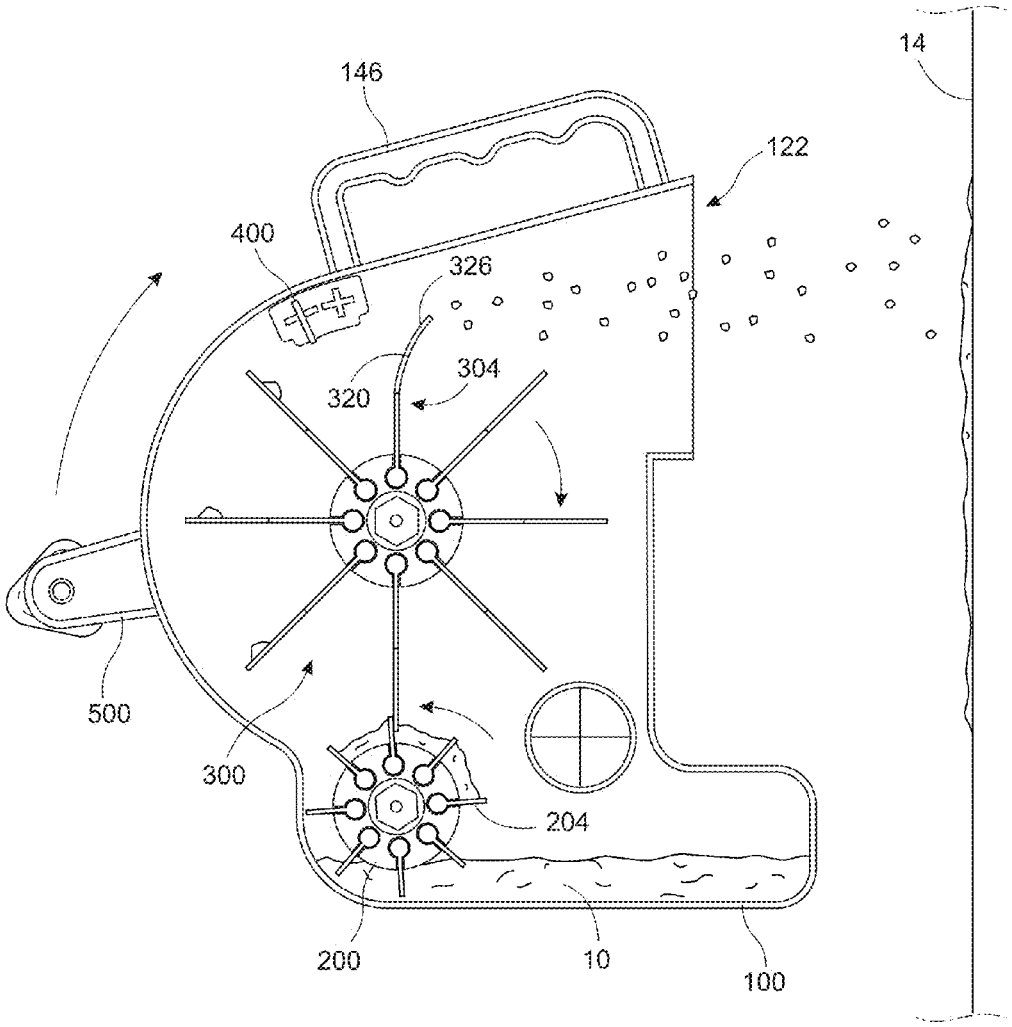

The flinging effect is due, in part, to the firing pin 400. In general, as shown in FIGS. 9A-9C, the firing pin 400 is an elongated member 402 attachable to the housing 100 above the propeller 300. The elongated member 402 defines a pin axis P. The firing pin 400 is far enough away from the propeller 300 so that only the paddles 326 can contact the firing pin P. The firing pin P is attachable to the housing 100 to create resistance for the fins 304 as the fins 304 rotate about the spindle axis S. The arms 320 of the fins 304 are flexible and the firing pin 400 is fixed and rigid. As the fins 304 rotate in a first direction, one of the fins 304 will contact the firing pin 400 as shown in FIG. 11B. Upon contact with the firing pin 400, the arms 320 of the fin 304 begin to bend backwardly in a second direction opposite to the first direction because of the rigidity of the firing pin 400, as shown in FIG. 11C. Eventually, the arms 320 are bent so far that the paddle 326 slides underneath the firing pin 400. As rotation of the fin 304 continues, the paddle 326 slides past the firing pin 400 and the potential energy created by bending the arm 320 backwardly is released and the arm 320 flings abruptly forward causing the material 10 on the paddle 326 to fling forwardly and out the opening 122, as shown in FIG. 11D.

The amount of potential energy created in the arms 320 of the fin 304 is determined not only by the flexibility of the arms 320, but also the dimensions of the firing pin 400. The closer the firing pin 400 is to the fins 304, the more potential energy that can be built up in the arms 320 of fins 304. Therefore, in order to be able to control the amount of potential energy built up in the arms 320 of the fins 304, the firing pin 400 can be made adjustable. In some embodiments, the relative location of the firing pin 400 can be adjusted. For example, a first through hole 148 may be created through the side walls 110, 112 at a specific location in the upper section 120 of the housing 100 above the fins 304. A second through hole 150 may be created through the side walls 110, 112 that are in front of and slightly higher than the first through hole 148. Since in the preferred embodiment, the top wall 108 is angled, this adjustment causes the firing pin 400 to be further away from the fins 304. Therefore, in this example, the amount of potential energy built up into the fins 304 can be decreased by adjusting the firing pin 400 from the first through hole 148 to the second through hole 150.

In some embodiments, the firing pin 400 may have different characteristics. In particular, as shown in FIG. 9A-9C, the firing pin 400 may comprise at least two protuberances 404, 406 projecting away from the elongated member 402, and preferably extending the length of the elongated member 402. The two protuberances 404, 406 may be of different sizes. The user can orient the firing pin 400 so that one of the two protuberances 404, 406 is directed towards the fins 304. In one embodiment, the protuberances 404, 406 may be on opposite sides. The user can remove the firing pin 400 from the housing 100, rotate the firing pin 400 180 degrees about the pin axis P, and re-insert the firing pin 400 back into the housing 100 so as to be in the opposite orientation.

In some embodiments, as shown in FIG. 9C the protuberances 404, 406 may be on cam lobes 408 so that the firing pin 400 does not have to be removed from the housing 100 in order to change the effective protuberance 404, 406. Rather, the firing pin 400 may be rotated about the pin axis P to change the effective protuberance. Therefore, the user can easily adjust the extent of the firing of the material 10 caused by actuation of the actuator 500. One of the holes 148, 150 would have to be adjusted so that the cam lobe can fit through the hole and lock in place in at least two different configurations.

The actuator 500 is mounted to the housing 100 and causes the propeller 300 to rotate in a first direction about the spindle axis S. The actuator 500 may be any device that causes the propeller 300 to rotate. For example, the actuator 500 may be a handle, a dial, a button, or the like. In the preferred embodiment, the actuator 500 is a handle having a proximal end 502 and a distal end 504. The proximal end 502 of the handle 500 is connected to the spindle 302. The distal end 504 can be grasped by the user and rotated about the spindle axis S to cause the spindle 302 to rotate in the same direction. This allows the user to continually spray the material 10 onto the wall. The user can control the intensity and speed with which the fins 304 rotate.

Figure 12:
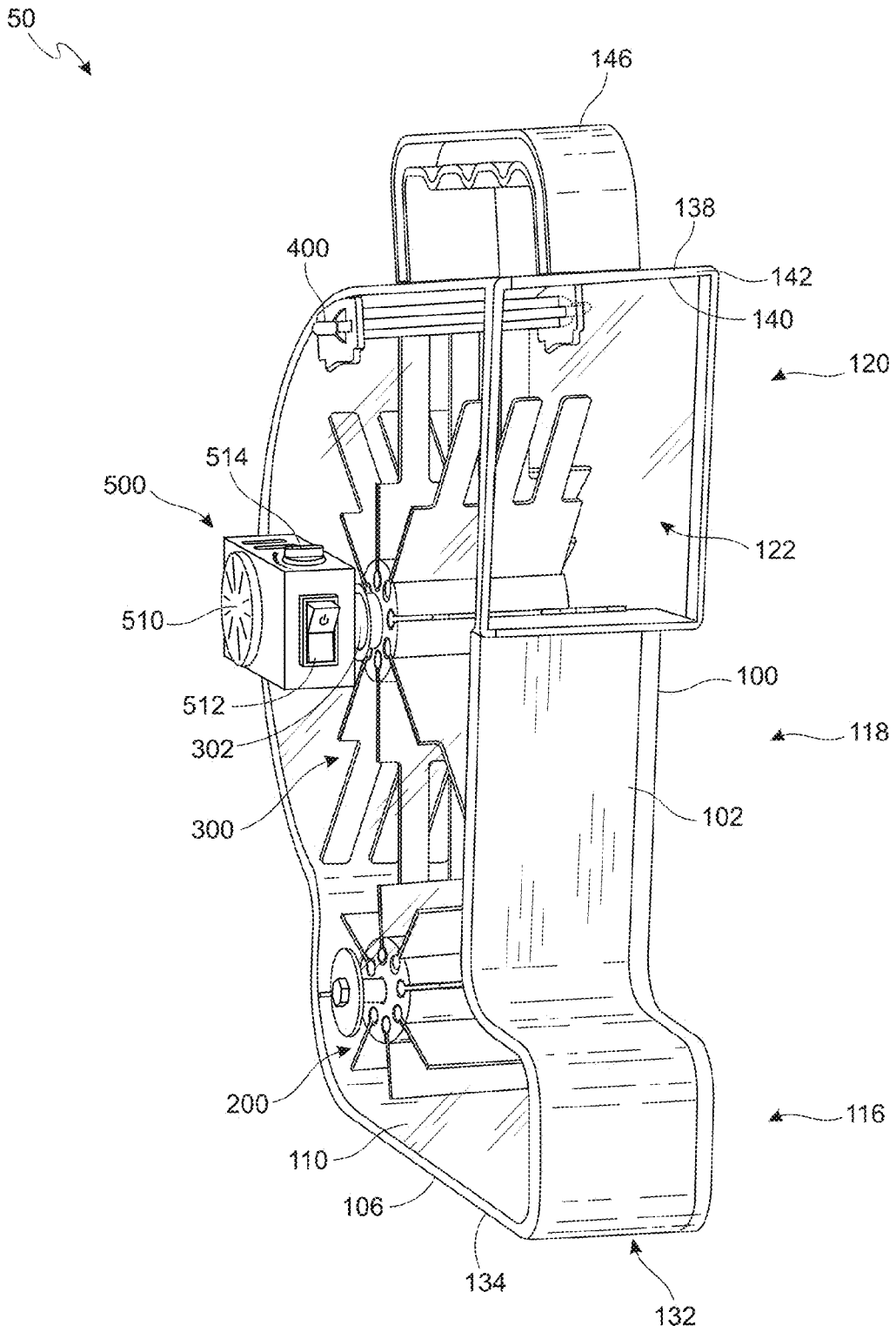
FIG. 12 shows a perspective view of another embodiment of the present invention.

In some embodiments, as shown in FIG. 12, the actuator 500 may be automated utilizing a small motor 510 connected to the spindle 302. The actuator 500 may have a switch 512 that starts the motor 510 causing spindle 302 to rotate in a first direction. The switch 512 may have a reverse direction as well. The motor 510 may also have a speed controller 514, for example, in the form of a dial, to adjust the speed of the propeller 300.

The firing pin 400, the propeller 300, and the transfer wheel 200 are arranged relative to each other such that rotation of the propeller 300 about the spindle axis S causes a first fin 304 to abut against one transfer flap 204. The abutment causes the transfer wheel 200 to rotate in a second direction about the hub axis H opposite the first direction, while a second fin 304 abuts against the firing pin 400 causing the second fin 304 to bend in the second direction until further rotation causes the second fin 304 to abruptly spring forward in the first direction. If there is material 10 residing on the paddles 326, then the material 10 will be flung forwardly and out the opening 122.

In use, as shown in FIG. 10-11D, the user inserts a material delivery 12 device into the fill hole 124. The material delivery device 12 contains material 10 to be applied to a wall 14. The material 10 from the delivery device is discharged into the lower section 116 of the cavity 114 of the housing 100 through the fill hole 124. Due to the location of the transfer wheel 200 in the lower section 116, at least a portion of the transfer wheel 200 will reside in the material 10. Upon actuation of the actuator 500, the propeller 300 will start to rotate in a first direction, as shown in FIG. 11B. Due to the relationship between the propeller 300 and the transfer wheel 200, the propeller 300 will begin rotating the transfer wheel 200 in a second direction that is opposite the first direction, as shown in FIG. 11B. As the transfer wheel 200 rotates, the transfer flaps 204 will scoop up the material 10. The paddles 326 on the propeller 300 will wipe some of the material 10 off of the transfer flap 204 and the material 10 will sit on the paddle 326 as the propeller 300 continues to rotate, sending the paddle 326 to the upper section 120 of the housing 100. At the upper section 120, the paddle 326 will abut against one of the protuberances 404, 406 of the firing pin 400. This will cause the flexible arms 320 to bend backwards as shown in FIG. 11C. As the propeller 300 continues to rotate, eventually the paddle 326 will slide underneath the protuberance 404, 406 and spring forward in an abrupt manner. This will propel the material 10 residing on the paddle 326 in the forward direction and out through the opening 122 as shown in FIG. 11D. The material 10 will land on the wall 14 and provide the perfect texture pattern on the wall. When complete, the housing 100 can be easily disassembled for cleaning.

The forgoing description has been presented for the purposes of illustration and description. It is not intended to be exhaustive or to limit the invention to the precise forms disclosed. Obvious modifications or variations are possible in light of the above teachings. The embodiment of embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A spray apparatus, comprising:

a) a housing defined by a front wall, a back wall opposite the front wall, a bottom wall adjacent to the front wall and the back wall, a top wall opposite the bottom wall, and adjacent to the front wall and the back wall, a first side wall adjacent to the front wall, the back wall, the bottom wall, and the top wall, and a second side wall opposite the first side wall and adjacent to the front wall, the back wall, the bottom wall, and the top wall, wherein the front wall, back wall, bottom wall, top wall, and two side walls define a cavity of the housing, wherein the housing comprises a lower section bound by the bottom wall, an upper section bound by the top wall, and a middle section therebetween, wherein the front wall at the upper section defines an opening into the cavity, wherein the top wall defines an angle relative to the bottom wall, the angle ranging from approximately 15 degrees to approximately 20 degrees, wherein the housing comprises a fill hole positioned below the opening, wherein the fill hole is covered by a flexible cover having a center, the flexible cover comprising slits that allow the cover to adopt an open configuration when a poignant pressure is applied to the center of the cover, and to adopt a closed configuration when the poignant pressure is removed the center of the cover;

b) a transfer wheel rotatably mounted to the first and second side walls, the transfer wheel comprising a cylindrical hub defining a hub axis, and a plurality of transfer flaps, wherein the hub axis is perpendicular to the first and second side walls, wherein the transfer flaps project radially outwardly from the cylindrical hub and are intermittently and angularly spaced apart about the hub axis;

c) a propeller rotatably mounted to the first and second side walls and positioned above the transfer wheel, the propeller comprising a cylindrical spindle defining a spindle axis, and a plurality of fins, wherein the spindle axis is parallel to the hub axis, wherein the fins project radially outwardly from the cylindrical spindle and are intermittently and angularly spaced apart about the spindle axis, wherein each fin comprises a set of flexible arms, each arm having a free terminal end;

d) a firing pin attached to the housing above the propeller, the firing pin comprising an elongated base member and a first and a second protuberance projecting from the elongated base member, the elongated base member having a length and defining a pin axis, each protuberance projecting a width away from the base member radially outwardly from the pin axis, each protuberance extending substantially the length of the elongated base member and spaced apart from each other, wherein the width of the first protuberance is greater than the width of the second protuberance, wherein the firing pin is adjustable to allow the first protuberance or the second protuberance to project towards the cylindrical spindle; and e) an actuator mounted to the housing, actuation of the actuator causing the propeller to rotate in a first direction about the spindle axis, wherein the firing pin, the propeller, and the transfer wheel are arranged relative to each other such that rotation of the propeller about the spindle axis causes one fin of the propeller to abut against one transfer flap, the abutment causing the transfer wheel to rotate in a second direction about the hub axis opposite the first direction, while a diametrically opposite fin abuts against the firing pin causing its set of flexible arms to bend in the second direction until further rotation causes the set of flexible arms to abruptly spring back in the first direction.

2. The spray apparatus of claim 1, where in each fin is removable from the spindle so as to be replaceable by another fin.

3. The spray apparatus of claim 1, wherein each transfer flap is removable from the hub so as to be replaceable by another transfer flap.

4. The spray apparatus of claim 1, wherein the actuator comprises a motor to automatically cause rotation of the spindle upon actuation.

5. A spray apparatus, comprising:

a) a housing defined by a front wall, a back wall opposite the front wall, a bottom wall adjacent to the front wall and the back wall, a top wall opposite the bottom wall, and adjacent to the front wall and the back wall, a first side wall adjacent to the front wall, the back wall, the bottom wall, and the top wall, and a second side wall opposite the first side wall and adjacent to the front wall, the back wall, the bottom wall, and the top wall, wherein the front wall, the back wall, the bottom wall, the top wall, and the two side walls define a cavity of the housing, wherein the housing comprises a lower section bound by the bottom wall, an upper section bound by the top wall, and a middle section therebetween, wherein the front wall at the upper section defines an opening into the cavity;

b) a transfer wheel rotatably mounted to the housing, the transfer wheel comprising a hub defining a hub axis, and a plurality of transfer flaps, wherein the hub axis is perpendicular to the first and second side walls, wherein the transfer flaps project radially outwardly from the hub and are intermittently and angularly spaced apart about the hub axis;

c) a propeller rotatably mounted to the housing and positioned above the transfer wheel, the propeller comprising a spindle and a plurality of fins, wherein the spindle defines a spindle axis, wherein the spindle axis is parallel to the hub axis, wherein the fins project radially outwardly from the spindle and are intermittently and angularly spaced apart about the spindle axis;

d) a firing pin attached to the housing above the propeller; and e) an actuator mounted to the housing, actuation of the actuator causing the propeller to rotate in a first direction about the spindle axis, wherein the firing pin, the propeller, and the transfer wheel are arranged relative to each other such that rotation of the propeller about the spindle axis causes a first fin to abut against one transfer flap, the abutment causing the transfer wheel to rotate in a second direction about the hub axis opposite the first direction, while a second fin abuts against the firing pin causing the second fin to bend in the second direction until farther rotation causes the second fin to abruptly spring back in the first direction.

6. The spray apparatus of claim 5, wherein the top wall defines an angle relative to the bottom wall, the angle ranging from approximately 10 degrees to approximately 30 degrees.

7. The spray apparatus of claim 5, wherein the housing comprises a fill hole positioned below the opening, wherein the fill hole is covered by a flexible cover having a center, the flexible cover comprising slits that allow the cover to adopt an open configuration when a poignant pressure is applied to the center of the cover, and to adopt a closed configuration when the poignant pressure is removed the center of the cover.

8. The spray apparatus of claim 5, wherein each fin comprises a set of flexible arms, each flexible arm having a free terminal end, each flexible arm within a set of flexible arms spaced apart from each other along their respective fins.

9. The spray apparatus of claim 8, wherein each free terminal end comprises a paddle having a width slightly larger than a width of its respective flexible arm.

10. The spray apparatus of claim 5, wherein each fin is removable from the spindle so as to be replaceable by another fin.

11. The spray apparatus of claim 5, wherein each transfer flap is removable from the hub so as to be replaceable by another transfer flap.

12. The spray apparatus of claim 5, wherein the firing pin comprises an elongated base member having a length and defining a pin axis, and a first and a second protuberance spaced apart from each other and projecting away from the elongated base member, each protuberance being a different size.

13. The spray apparatus of claim 12, wherein the firing pin is adjustable to allow the first protuberance or the second protuberance to project towards the spindle.

14. The spray apparatus of claim 13, wherein the firing pin comprises a cam lobe.

15. The spray apparatus of claim 5, wherein the actuator comprises a motor to automatically cause rotation of the spindle upon actuation.

* * * * *